US009381133B2

(12) United States Patent
Chen

(10) Patent No.: US 9,381,133 B2
(45) Date of Patent: Jul. 5, 2016

(54) AUTOMATIC PATTING MECHANISM

(71) Applicant: Joong Chenn Industry Co., Ltd., Nantou (TW)

(72) Inventor: James Chen, Nantou (TW)

(73) Assignee: JOONG CHENN INDUSTRY CO., LTD., Nantou (TW)

( * ) Notice: Subject to any disclaimer, the term of this patent is extended or adjusted under 35 U.S.C. 154(b) by 373 days.

(21) Appl. No.: 13/967,048

(22) Filed: Aug. 14, 2013

(65) Prior Publication Data

US 2014/0088472 A1 Mar. 27, 2014

(30) Foreign Application Priority Data

Sep. 26, 2012 (TW) ..... 101135426 A

(51) Int. Cl.
*A61H 23/00* (2006.01)
*A61H 23/02* (2006.01)

(52) U.S. Cl.
CPC ..... *A61H 23/006* (2013.01); *A61H 23/02* (2013.01); *A61H 2201/0149* (2013.01); *A61H 2201/1215* (2013.01); *A61H 2201/1418* (2013.01); *A61H 2201/1623* (2013.01); *A61H 2205/081* (2013.01)

(58) Field of Classification Search
CPC ..... A61H 23/02; A61H 23/006; A61H 2201/0149; A61H 2201/1215; A61H 2201/1418; A61H 2201/1623; A61H 2205/081; A61H 7/005; A61H 7/007
USPC ..... 601/84, 86, 87, 90, 93, 98, 101, 106, 601/107, 108, 111
See application file for complete search history.

(56) References Cited

U.S. PATENT DOCUMENTS

| | | | | |
|---|---|---|---|---|
| 3,939,826 A * | 2/1976 | Fujimoto | A61H 23/0254 601/111 |
| 4,951,331 A * | 8/1990 | Pereira | A47D 9/02 5/109 |
| 5,904,661 A * | 5/1999 | Bonz | A61H 7/005 601/101 |
| 2003/0120187 A1* | 6/2003 | Kan | A61H 7/007 601/99 |

FOREIGN PATENT DOCUMENTS

TW M403340 5/2011

* cited by examiner

*Primary Examiner* — Quang D Thanh
(74) *Attorney, Agent, or Firm* — Muncy, Geissler, Olds & Lowe, P.C.

(57) ABSTRACT

A patting mechanism includes a support base for support a user, a driving device mounted to the support base and having a pushing unit, and a patting device having a rod pivotally connected with the support base, a patting member fixedly connected with the rod, and an elastic member connected between the support base and the rod. Thus, the rod is pushed to a preloaded position when the pushing unit is activated, and the rod is pulled by the elastic member to a patting position when the pushing unit is stopped working, such that the patting member is driven by the rod to pat on the user's back muscle repeatedly to relieve muscle soreness or help the user spit out phlegm.

10 Claims, 8 Drawing Sheets

AUTOMATIC PATTING MECHANISM

BACKGROUND OF THE INVENTION

1. Field of the Invention

The present invention relates generally to a patting mechanism, and more specifically to a patting mechanism, which can be operated automatically.

2. Description of the Related Art

Today many people lead a busy life which is highly active and busy without getting enough rest, and therefore pain may occur in the neck and shoulders. Once the neck and shoulder pain is accumulated over a long time, it can affect the entire body, contributing to a variety of health issues. In order to alleviate this problem, self-massage is the most common way to relieve pain in the body, but it is insufficient for many persons to relax the muscles by using their fingers, such that a manual patting massager can be used to help release tension in certain muscles. However, the manual patting massager is operated to hit in a restricted zone and meanwhile a user is difficult to control hitting strength, resulting in that the manual patting massager will fail to meet the user's expectation.

Besides massage, a little pat on a patient's back will help the patient cough up phlegm from the patient's lungs, preventing pneumonia or bronchitis caused by accumulation of excessive phlegm in the lungs. A known mucus clearance device is disclosed in Taiwan Patent No. M403340, which comprises a motor and a cam connected with the motor. When the cam is rotated, a rod is pushed by the cam to drive a patting member to tap the patient's back. However, the prior art device is inconvenient for the user to use because the user needs somebody's help to operate the prior art device, and further, the cam and the rod are in direct contact with each other such that the cam or the rod is easy to wear when used for long periods of time, causing a negative influence on the operation of the prior art device.

SUMMARY OF THE INVENTION

It is one objective of the present invention to provide an automatic patting mechanism, which can pat on a specific part of a user's body continuously to relieve muscle tension or help the user spit out phlegm.

To achieve this objective of the present invention, the automatic patting mechanism provided by the present invention comprises a support base, a driving device, and a patting device. The support base is provided for supporting a user. The driving device is mounted to the support base and provided with a power supply and a pushing unit electrically connected with the power supply. The patting device includes a patting member, a rod abutted against the pushing unit and having one end fixedly connected with the patting member and the other end pivotally connected with the support base, and an elastic member connected between the support base and the rod. By this way, the rod can be pushed by the pushing unit to be pivotable relative to the support base between a patting position and a preloaded position, and pulled by the elastic member from the preloaded position to the patting position. When the rod is located at the patting position, the patting member is driven to pat on the user's body to relax the user's muscle or help the user spit out phlegm.

Preferably, the pushing unit includes a motor electrically connected with the power supply and having a rotating shaft and a cam connected with the rotating shaft of the motor and abutted against a roller mounted with the rod, such that the roller can be pushed by the cam to drive the rod to move from the patting position to the preload position.

Preferably, the support base includes a seat frame and a seat cushion disposed on the seat frame. The power supply is mounted to the seat frame and located under the seat cushion, and the rod has a bottom end pivotally connected with the seat frame and a top end extending over the seat cushion and fixedly connected with the patting member, and the elastic member is connected between the seat frame and the rod.

Preferably, the support base includes two spaced back cushions disposed on the seat frame and vertical to the seat cushion. The top end of the rod is located between the two back cushions when the rod is located at the patting position.

Preferably, the seat frame includes a bottom plate, a back plate vertically connected with the bottom plate, and a first extending post fixedly connected with the back plate. The power supply is mounted to the bottom plate, and the motor is mounted to the back plate in such a way that the rotating shaft of the motor is protruded out of the back plate, and the bottom end of the rod is pivotally connected with a distal end of the first extending post.

Preferably, when the rod is located at the patting position, the rod presses a buffer protector mounted on the back plate.

Preferably, the buffer protector has a second extending post fixedly connected with the back plate and a buffer block mounted to the second extending post and pressed by the rod when the rod is located at the patting position.

Preferably, the cam has a flat section, an upgrade section adjoined with the flat section, and a downgrade section adjoined between the flat section and the upgrade section. The rod is pivotally moved from the patting position to the preloaded position when the roller is moved from the flat section to the upgrade section, and the rod is pulled by the elastic member to be pivotally moved from the preloaded position to the patting position when the roller is moved from the upgrade section to the flat section through the downgrade section.

Preferably, the slope of the downgrade section is larger than the slope of the upgrade section.

Preferably, the roller is connected with the rod through an L-shaped lever.

Preferably, the rod is a telescopic rod.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
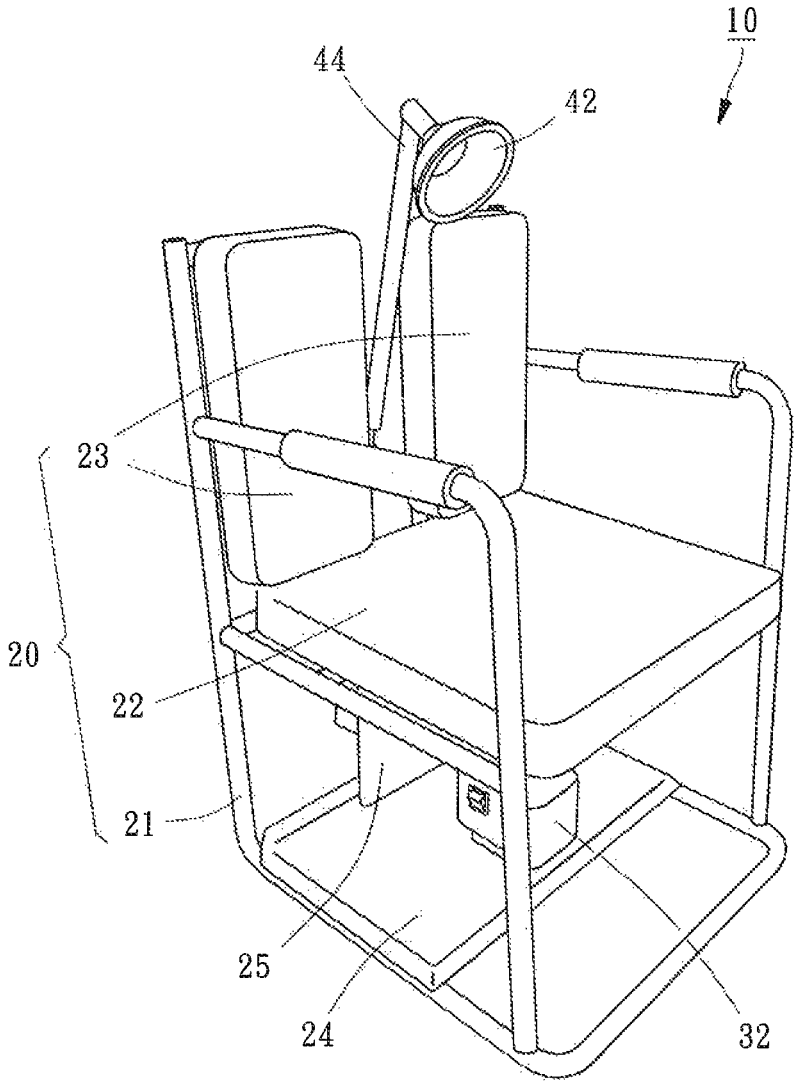
FIG. 1 is a perspective view of an automatic patting mechanism according to a first embodiment of the prevent invention.
Figure 2:
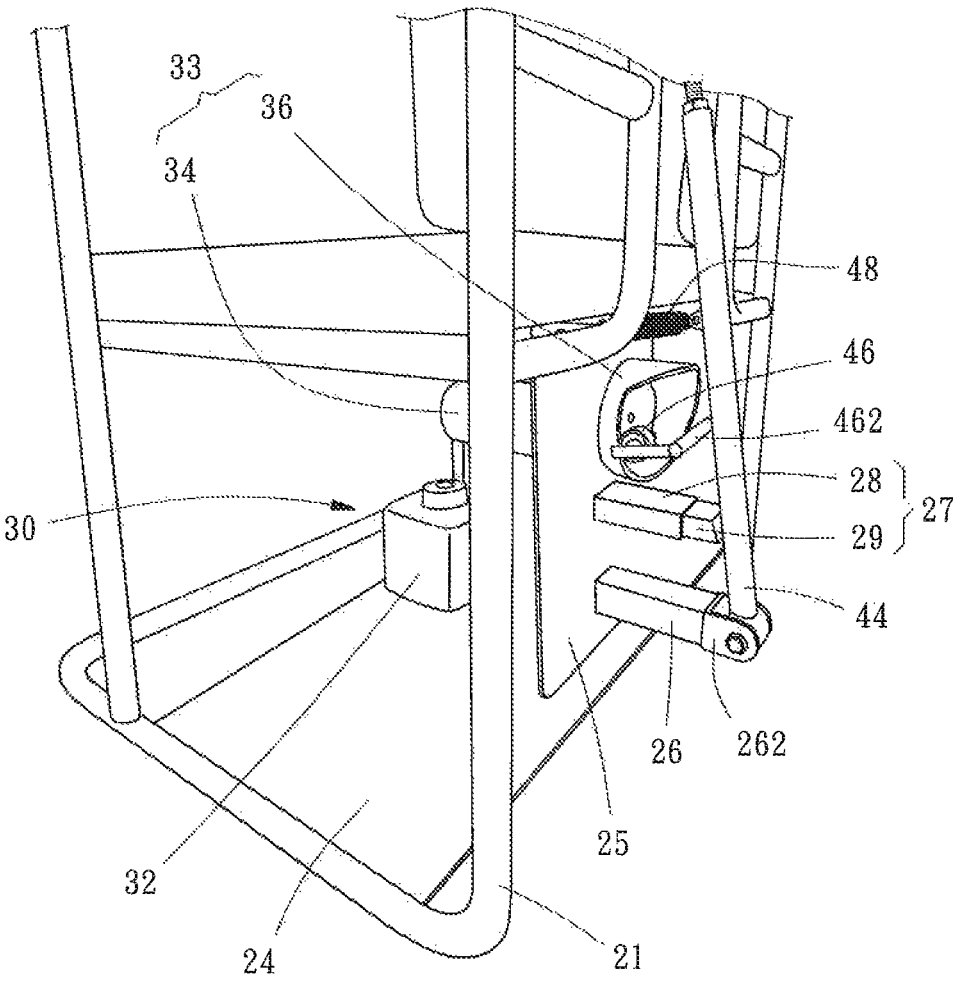
FIG. 2 is a perspective view of a part of the automatic patting mechanism according to the first embodiment of the prevent invention, showing the structural relationship among the cam, the rod, and the roller.
Figure 3:
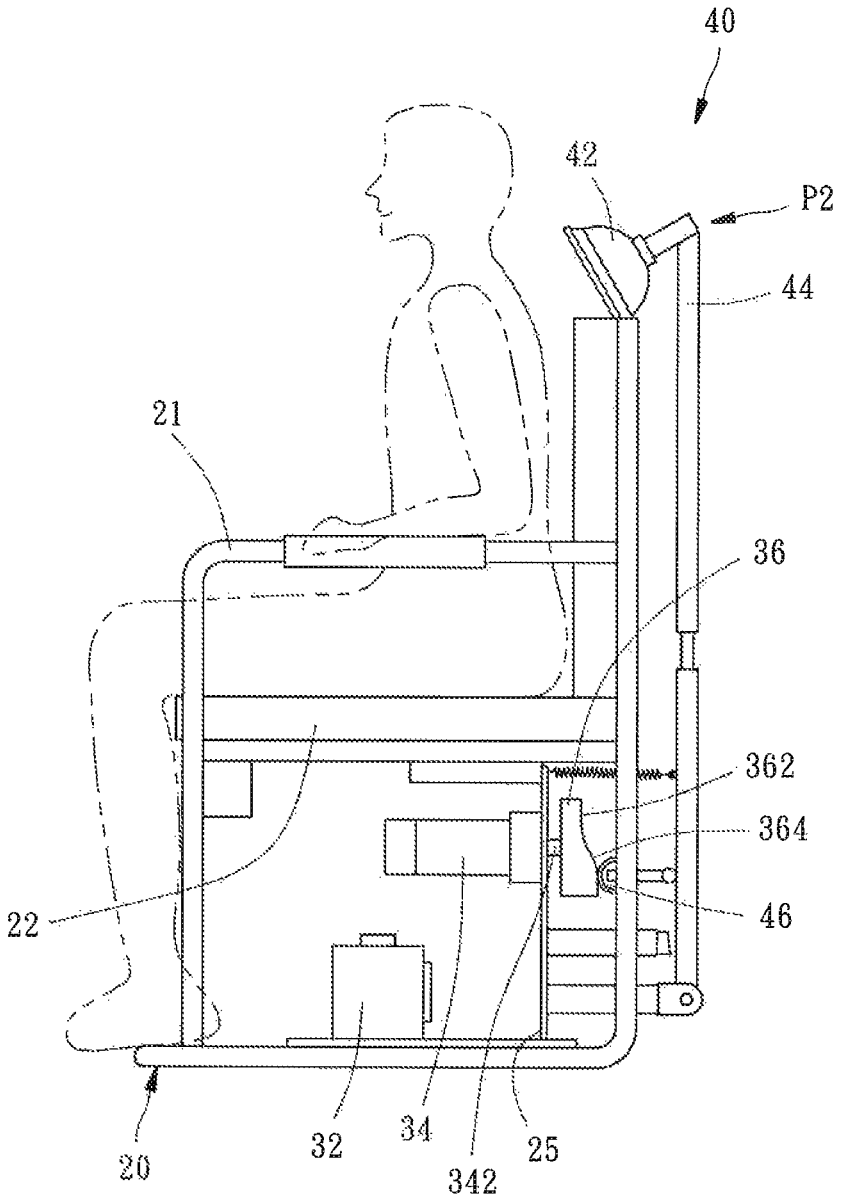
FIG. 3 is a lateral view of the automatic patting mechanism according to the first embodiment of the prevent invention, showing that the rod is located at the preloaded position.

As shown in FIGS. 1 to 3, an automatic patting mechanism 10 in accordance with a first embodiment of the present invention comprises a support base 20, a driving device 30, and a patting device 40.

The support base 20 includes a seat frame 21 placed on the ground, a seat cushion 22 disposed on the seat frame 21 for providing a user to sit, and two spaced back cushions 23 disposed on the seat frame 21 and vertical to the seat cushion 22 for providing back support and comfort. As shown in FIG. 2, the seat frame 21 includes a bottom plate 24, a back plate 25 vertically connected with a rear side of the bottom plate 24, a first extending post 26 having one end fixedly connected with the back plate 25 and extending away from the back plate 25 to form a lug 262 at the other end, and a buffer protector 27 located above the first extending post 26 and provided with a second extending post 28 having one end fixed to the back plate 25 and extending away from the back plate 25 to be connected with a buffer block 29.

Figure 7:
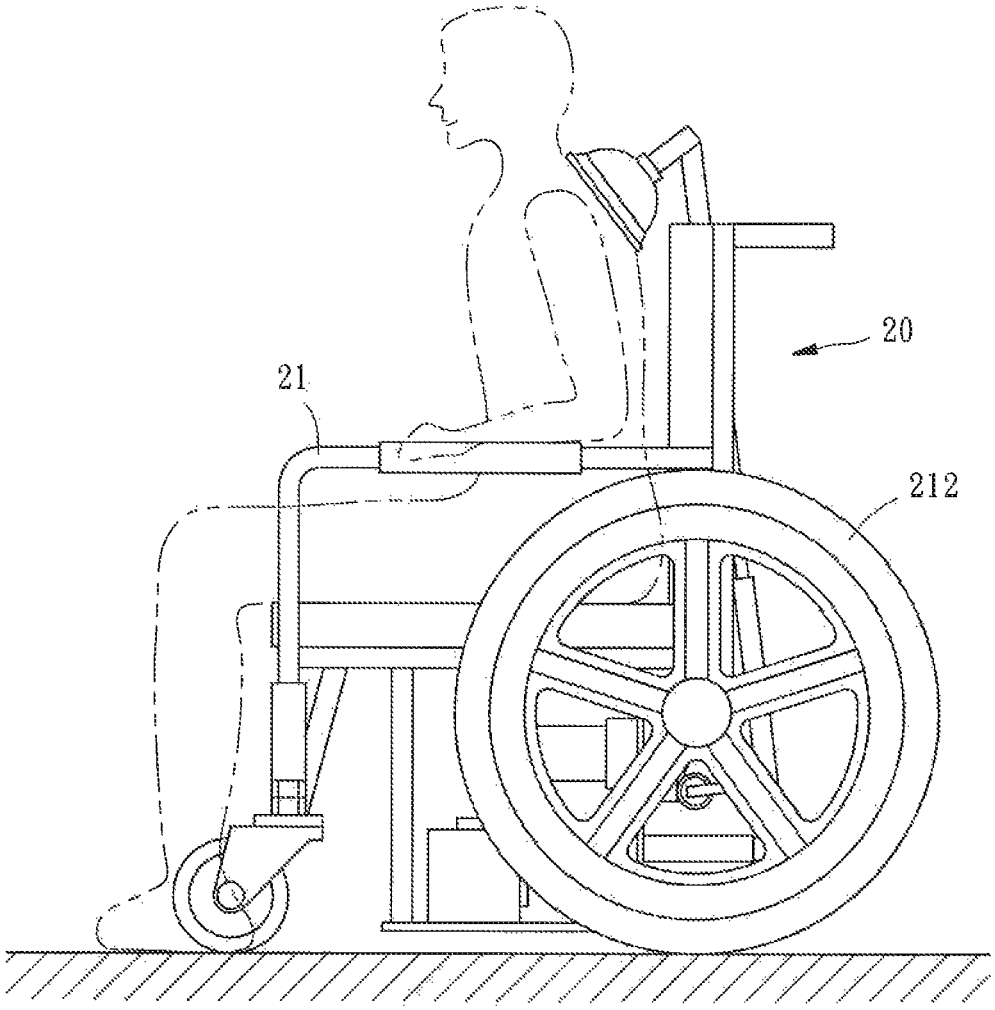
FIG. 7 is a lateral view of the automatic patting mechanism according to a second embodiment of the prevent invention.

To deserve to be mentioned, the support base 20 can be made with various kinds of design on the basis of the spirit of the present invention, but not limited to be designed as a chair. For example, the seat frame 21 can be equipped with two wheels 212 such that the support base 20 is designed to be a wheelchair for people with disabilities, as shown in FIG. 7.

Figure 4:
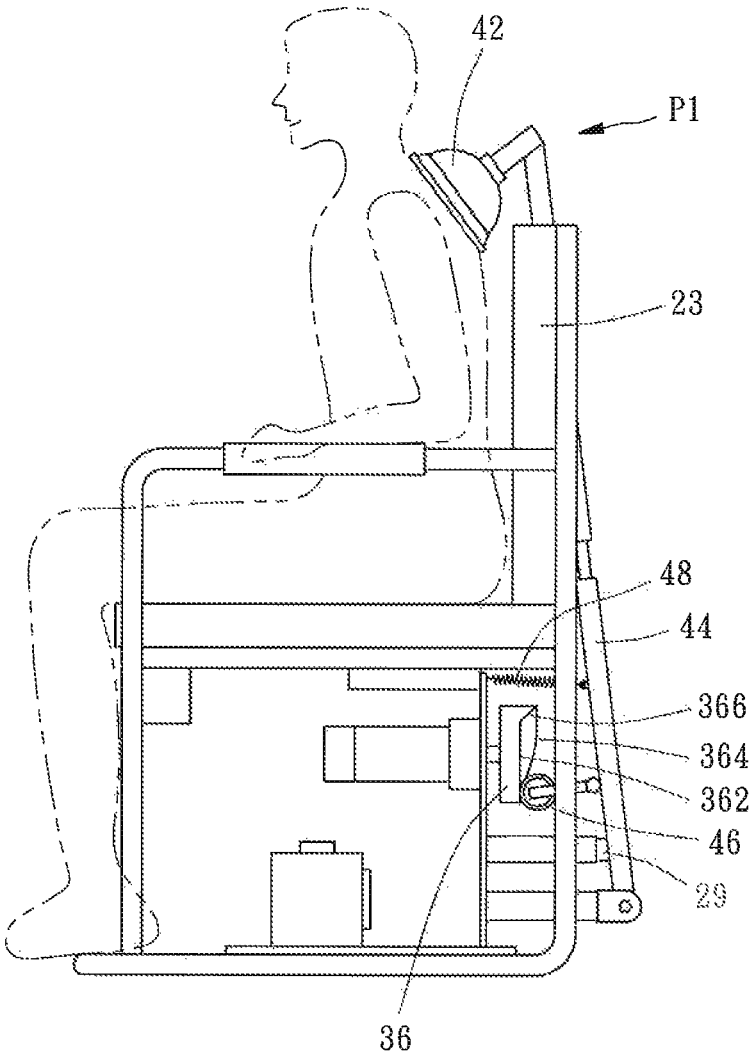
FIG. 4 is similar to FIG. 3, but showing that the rod is located at the patting position.

The driving device 30 includes a power supply 32 mounted on the bottom plate 24 of the seat frame 21 of the support base 20 for providing electricity, and a pushing unit 33 having a motor 34 electrically connected with the motor 34 and mounted to the back plate 25 of the seat frame 21 of the support based 20 and provided with a rotating shaft 342 protruding out of the back plate 25, as shown in FIG. 3, such that the rotating shaft 342 of the motor 34 can be driven by the power supply 32 to rotate. A cam 36 is mounted on the rotating shaft 342 of the motor 34 so as to be rotated along with the rotating shaft 342; and further, as shown in FIGS. 3 and 4, the cam 36 has a flat section 362, an upgrade section 364 adjoined with the flat section 362, and a downgrade section 366 adjoined between the flat section 362 and the upgrade section 364. The slope of the downgrade section 366 is larger than the slope of the upgrade section 364.

The patting device 40 includes a bowl-shaped patting member 42 and a rod 44 having a bottom end pivotally connected with the lug 262 of the first extending post 26 of the seat frame 21 and a top end extending over the seat cushion 22 and fixedly connected with the patting member 42 such that the rod 44 is pivotable relative to the support base 20 between a patting position P1 (as shown in FIG. 4) and a preloaded position P2 (as shown in FIG. 3). A roller 46 is connected with the rod 44 through an L-shaped lever 462 and abutted against the cam 36 such that the roller 46 can be moved from the flat section 362 to the downgrade section 366 through the upgrade section 364 when the cam 36 is rotated in a circle, and meanwhile the rod 44 can be driven to be pivotally moved between the patting position P1 and the preloaded position P2 during the rotation of the roller 46. Further, three elastic members 48 are respectively connected between the seat frame 21 of the support base 20 and the rod 44 for pulling the rod 44 from the preloaded position P2 to the patting position P1, as shown in FIG. 4.

Figure 5:
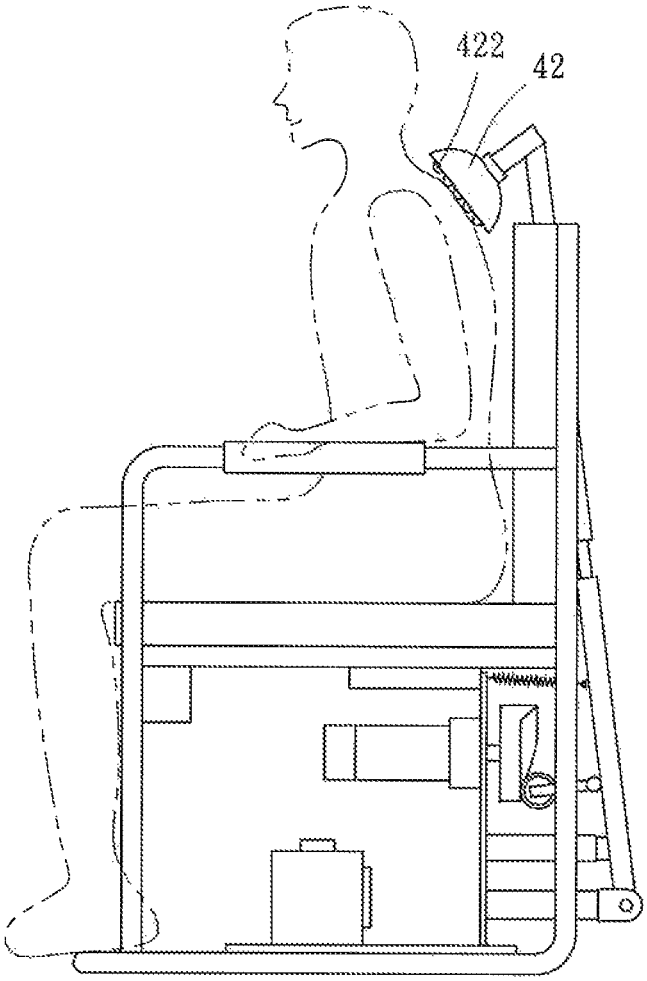
FIG. 5 is similar to FIG. 4, showing that the patting member has a plurality of massage dots.
Figure 6:
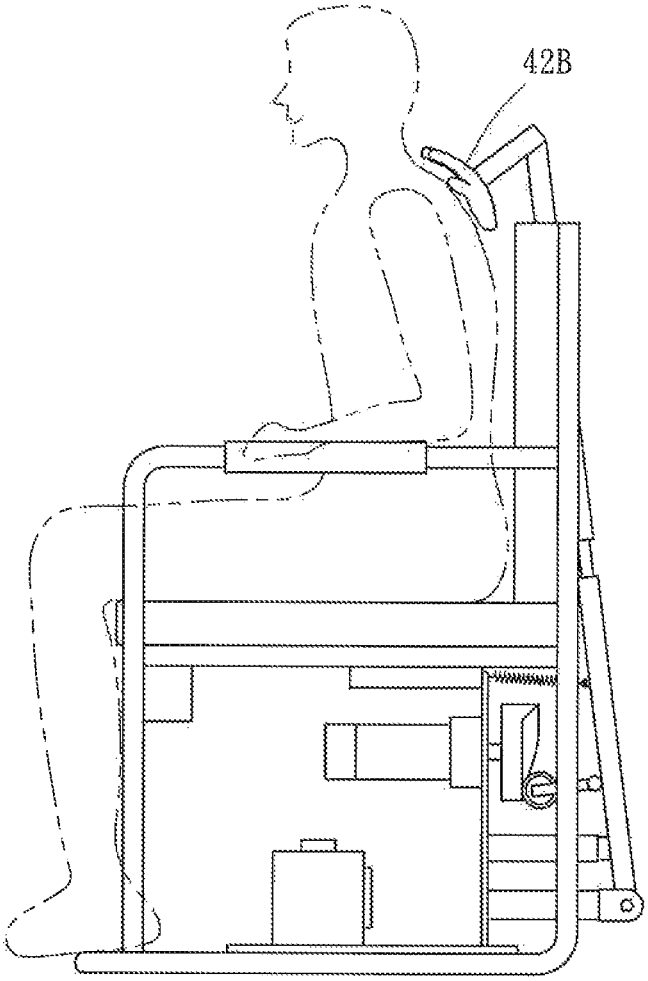
FIG. 6 is similar to FIG. 4, showing that the patting member has a hand-shaped design.
Figure 8:
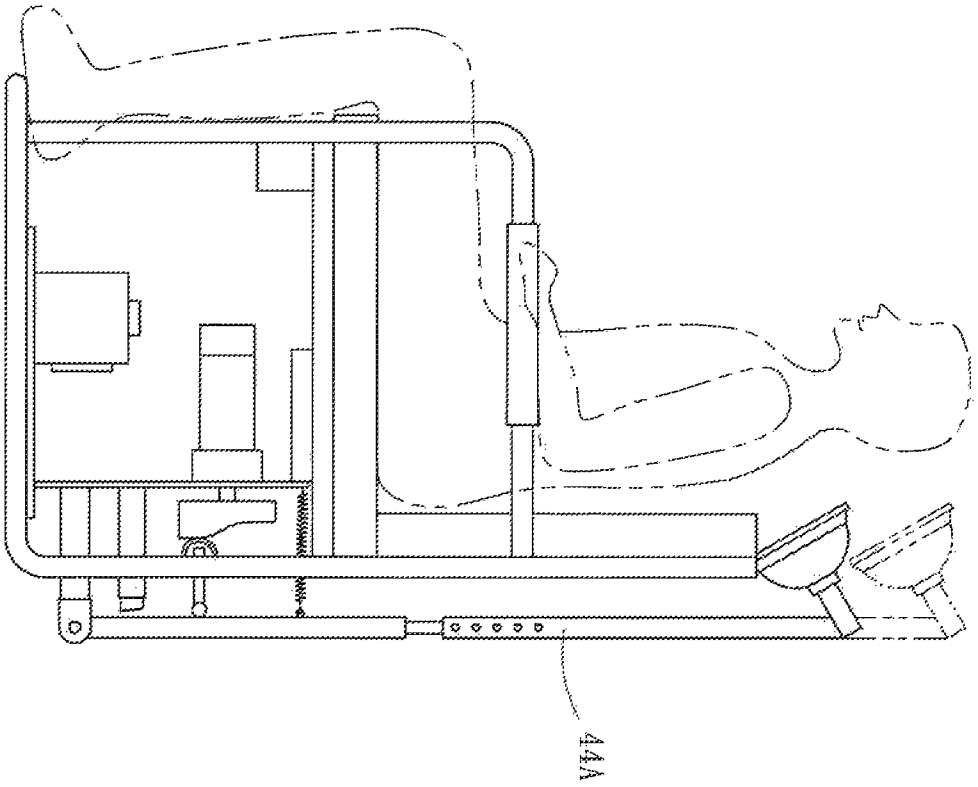
FIG. 8 is similar to FIG. 3, showing that a telescopic rod is used.

To deserve to be mentioned, the power supply 32 and the motor 34 can be substituted for an air compressor (not shown) and a pneumatic cylinder (not shown). By this way, the pneumatic cylinder is driven by the air compressor to push the rod 44 from the patting position P1 to the preloaded position P2. Besides, the rod 44 can be designed to be a telescopic rod 44A in order that the position of the patting member 42 can be adjustable according to the user's height, as shown in FIG. 8. In addition, the number of the elastic member 48 can be changeable as long as the patting device 40 is equipped with one elastic member 48 for providing a rebound force to the rod 44. Further, the patting device 40 can be equipped with two or more patting members 42 for providing better patting effects, and furthermore, the patting device 40 can be equipped with a half-ball shaped patting member 42A (as shown in FIG. 5), a half-ball shaped patting member 42A with a plurality of massage dots 422 (as shown in FIG. 5), or a hand-shaped patting member 42B (as shown in FIG. 6) for providing better massage effects.

After understanding of the structural details of the automatic patting mechanism 10, the operation and features of the automatic patting mechanism 10 are outlined hereinafter.

At first, the user sits on the seat cushion 22 and grips the seat frame 21, and then aims a to-be-bit body part (such as the neck, shoulder or upper back) toward the patting member 42. Thereafter, the user can start the motor 34 to drive the cam 36 to rotate. During the rotation of the cam 36, the rod 44 is pushed by the roller 46 to be pivoted to the preloaded position P2 when the roller 46 is moved from the flat section 362 to the upgrade section 364, as shown in FIG. 3, and the rod 44 isn't pushed by the roller 46 and pulled by the elastic members 48 to be pivoted to the patting position P1 when the roller 46 is moved from the upgrade section 364 to the flat section 362 through the downgrade section 366, as shown in FIG. 4. Once the rod 44 is located at the patting position P1, the bottom end of the rod 44 presses on the buffer block 29 for protection, as shown in FIGS. 2 and 4, and meanwhile the top end of the rod 44 is located between the two back cushions 23, such that the patting member 42 is driven by the rod 44 to apply its full force on the human body, as shown in FIG. 4. Accordingly, as long as the user keeps the cam 36 rotating, the rod 44 can be pivotally moved between the patting position P1 and the preloaded position P2 to let the patting member 42 generate a continuous patting effect until the user's desired needs are met.

As indicated above, the patting mechanism 10 of the present invention uses the patting member 42 to pat on a large area of the human body automatically and repeatedly to relieve muscle tension or enable the user to spit out phlegm without other's help, thereby achieving the advantages of saving time and effort and enhancing convenience of operating. Further, the patting mechanism 10 of the present invention uses the cam 36 to push the rod 44 through the roller 46, such that the cam 36 and the rod 44 are not physically in contact with each other, and therefore the wear between the cam 36 and the rod 44 can be reduced and the service lift of the patting mechanism 10 can be increased. Finally, when compared with the location of the torsion spring of the prior art, the elastic member 48 of the present invention provides a better rebound force to the rod 44 because the connection between the rod 44 and the elastic member 48 is spaced a distance from a pivot joint of the rod 44.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automatic patting mechanism comprising:

a support base for supporting a user;

a driving device mounted to the support base and having a power supply and a pushing unit electrically connected with the power supply; and a patting device including a patting member, a rod abutted against the pushing unit and having one end fixedly connected with the patting member and the other end pivotally connected with the support base such that the rod is pushed by the pushing unit to be pivotable relative to the support base between a patting position and a preloaded position, and an elastic member connected between the support base and the rod for pulling the rod from the preloaded position to the patting position, wherein the support base includes a seat frame and a seat cushion disposed on the seat frame; the power supply is mounted to the seat frame and located under the seat cushion, and the rod has a bottom end pivotally connected with the seat frame and a top end extending over the seat cushion and fixedly connected with the patting member, and the elastic member is connected between the seat frame and the rod.

2. The automatic patting mechanism as claimed in claim 1, wherein the pushing unit includes a motor electrically connected with the power supply and having a rotating shaft, and a cam mounted on the rotating shaft of the motor, and the patting device includes a roller connected with the rod and abutted against the cam such that the roller is pushed by the cam to drive the rod to be pivotally moved from the patting position to the preloaded position.

3. The automatic patting mechanism as claimed in claim 1, wherein the support base includes two spaced back cushions disposed on the seat frame and vertical to the seat cushion; the top end of the rod is located between the two back cushions when the rod is located at the patting position.

4. The automatic patting mechanism as claimed in claim 1, wherein the seat frame includes a bottom plate, a back plate vertically connected with the bottom plate, and a first extending post fixedly connected with the back plate; the power supply is mounted to the bottom plate, and the motor is mounted to the back plate in such a way that the rotating shaft of the motor is protruded out of the back plate, and the bottom end of the rod is pivotally connected with a distal end of the first extending post.

5. The automatic patting mechanism as claimed in claim 4, wherein when the rod is located at the patting position, the rod presses a buffer protector mounted on the back plate.

6. The automatic patting mechanism as claimed in claim 5, wherein the buffer protector has a second extending post fixedly connected with the back plate and a buffer block mounted to the second extending post and pressed by the rod when the rod is located at the patting position.

7. The automatic patting mechanism as claimed in claim 2, wherein the cam has a flat section, an upgrade section adjoined with the flat section, and a downgrade section adjoined between the flat section and the upgrade section; the rod is pivotally moved from the patting position to the preloaded position when the roller is moved from the flat section to the upgrade section, and the rod is pulled by the elastic member to be pivotally moved from the preloaded position to the patting position when the roller is moved from the upgrade section to the flat section through the downgrade section.

8. The automatic patting mechanism as claimed in claim 7, wherein a slope of the downgrade section is larger than a slope of the upgrade section.

9. The automatic patting mechanism as claimed in claim 2, wherein the roller is connected with the rod through an L-shaped lever.

10. The automatic patting mechanism as claimed in claim 1, wherein the rod is a telescopic rod.

* * * * *